US008729998B2

(12) United States Patent
Outten et al.

(10) Patent No.: US 8,729,998 B2
(45) Date of Patent: May 20, 2014

(54) THREE-STEP CORE FOR A NON-LINEAR TRANSFORMER

(75) Inventors: Samuel S. Outten, Washington, DC (US); Thomas A. Hartmann, Wytheville, VA (US)

(73) Assignee: ABB Technology, Zurich (CH)

( * ) Notice: Subject to any disclaimer, the term of this patent is extended or adjusted under 35 U.S.C. 154(b) by 5 days.

(21) Appl. No.: 13/489,565

(22) Filed: Jun. 6, 2012

(65) Prior Publication Data

US 2013/0328652 A1 Dec. 12, 2013

(51) Int. Cl.

| | |
|---|---|
| ***H01F 30/12*** | (2006.01) |
| ***H01F 21/02*** | (2006.01) |
| ***H01F 27/24*** | (2006.01) |

(52) U.S. Cl.

USPC ..... 336/5; 336/15; 336/211; 336/215; 336/216

(58) Field of Classification Search

CPC ..... H01F 30/12
USPC ..... 336/5
See application file for complete search history.

(56) References Cited

U.S. PATENT DOCUMENTS

| | | | | |
|---|---|---|---|---|
| 5,202,664 | A | 4/1993 | Poulsen | |
| 6,683,524 | B1 | 1/2004 | Hoeglund | |
| 6,809,620 | B2 * | 10/2004 | Hoglund | 336/5 |
| 6,880,228 | B2 * | 4/2005 | Bolotinsky et al. | 29/596 |
| 2010/0194515 | A1 | 8/2010 | Hurst et al. | |

FOREIGN PATENT DOCUMENTS

| | | | |
|---|---|---|---|
| FR | 225820 | A2 | 11/1974 |
| SU | 557679 | A1 | 6/1978 |

OTHER PUBLICATIONS

Brice Rouzier, International Searching Authority (EPO), International Search Report and Written Opinion of the International Searching Authority for corresponding International Application No. PCT/US2013/044434, European Patent Office, mailed Sep. 24, 2013.

* cited by examiner

*Primary Examiner* — Alexander Talpalatski
*Assistant Examiner* — Ronald Hinson
(74) *Attorney, Agent, or Firm* — Melissa J. Szczepanik

(57) ABSTRACT

A three step non-linear transformer core is formed from three sections of laminations each having different widths and cross-sectional areas. A first section of laminations is formed by cross-slitting a generally rectangular sheet or strip of metal. A resulting generally triangular segment is then wound upon a mold to form a first section of a core frame having a trapezoidal cross section. A second section of laminations is wound upon the first section of laminations to form a segment of a core frame having a rhombic cross section. The third section of laminations is wound upon the second section of laminations to form a segment of a core frame having a trapezoidal cross section. Each of the first, second, and third sections of laminations are offset from one another by a predetermined angle of offset.

14 Claims, 5 Drawing Sheets

THREE-STEP CORE FOR A NON-LINEAR TRANSFORMER

FIELD OF INVENTION

The present application is directed to a transformer having a non-linear core and a method of manufacturing the non-linear core.

BACKGROUND

Transformers having non-linear, or delta-shaped cores, are typically more labor-intensive to manufacture than in-line core transformers, i.e. transformers having core legs arranged in a linear fashion between two yokes. However, the resulting efficiency of non-linear transformers often outweighs the cost of producing them.

The intricacy of manufacturing a non-linear core increases with the use of material such as amorphous metal. Amorphous metal is delicate and difficult to form into even standard shapes. Minimal processing yields a better result in regards to forming a transformer core, especially in a core produced using amorphous metal. Prior art processes are time-consuming and may damage the material used in the core. Therefore, there is a need in the art for an improved non-linear core and method of manufacturing the same.

SUMMARY

A three-phase non-linear transformer has a ferromagnetic core formed of at least three core frames. Each of the at least three core frames has first, second, and third sections of laminations. The first, second, and third sections of laminations are wound successively upon one another to form a substantially semi-circular cross section of lamination layers wherein each first layer of the first, second and third sections of laminations is positioned at an angle of offset from adjacent layers. The at least three core frames are arranged in a non-linear configuration and each have a leg section and a yoke section. Each leg section combines with a leg section of another core frame to form at least three core legs having substantially circular cross-sections, respectively. Coil assemblies are mounted to each of the at least three core legs, respectively. The coil assemblies have a secondary winding wound around each of the at least three core legs, respectively and a primary winding disposed around the secondary winding.

A method of manufacturing a non-linear transformer core, is comprised of the following steps:

a. cross-slitting a first section of laminations;

b. winding the first section of laminations in successive layers around a mold so that at least the first layer of the first section of laminations has an angle of offset from adjacent layers of laminations within the first section and a second section;

c. winding a second section of laminations onto the first section of laminations so that at least the first layer of the second section of laminations has an angle of offset from adjacent laminations in the first section and a third section;

d. cross-slitting the third section of laminations; and e. winding the third section of laminations onto the second section of laminations so that at least a first layer of the third section of laminations has an angle of offset from adjacent laminations of the second section.

A transformer core has at least three core frames formed of first, second, and third sections of laminations. The first, second, and third sections of laminations are wound successively upon one another to form a substantially semi-circular cross section of lamination layers wherein at least the first layer of each section of laminations is positioned at an angle of offset from adjacent layers. The at least three core frames are arranged in a non-linear configuration. Each of the at least three core frames has a leg section and a yoke section. Each leg section of each core frame combines with another leg section of another core frame to form at least three core legs having substantially circular cross-sections, respectively.

BRIEF DESCRIPTION OF THE DRAWINGS

In the accompanying drawings, structural embodiments are illustrated that, together with the detailed description provided below, describe exemplary embodiments of a three-step core for a non-linear transformer. One of ordinary skill in the art will appreciate that a component may be designed as multiple components or that multiple components may be designed as a single component.

Further, in the accompanying drawings and description that follow, like parts are indicated throughout the drawings and written description with the same reference numerals, respectively. The figures are not drawn to scale and the proportions of certain parts have been exaggerated for convenience of illustration.

DETAILED DESCRIPTION

Figure 1A:
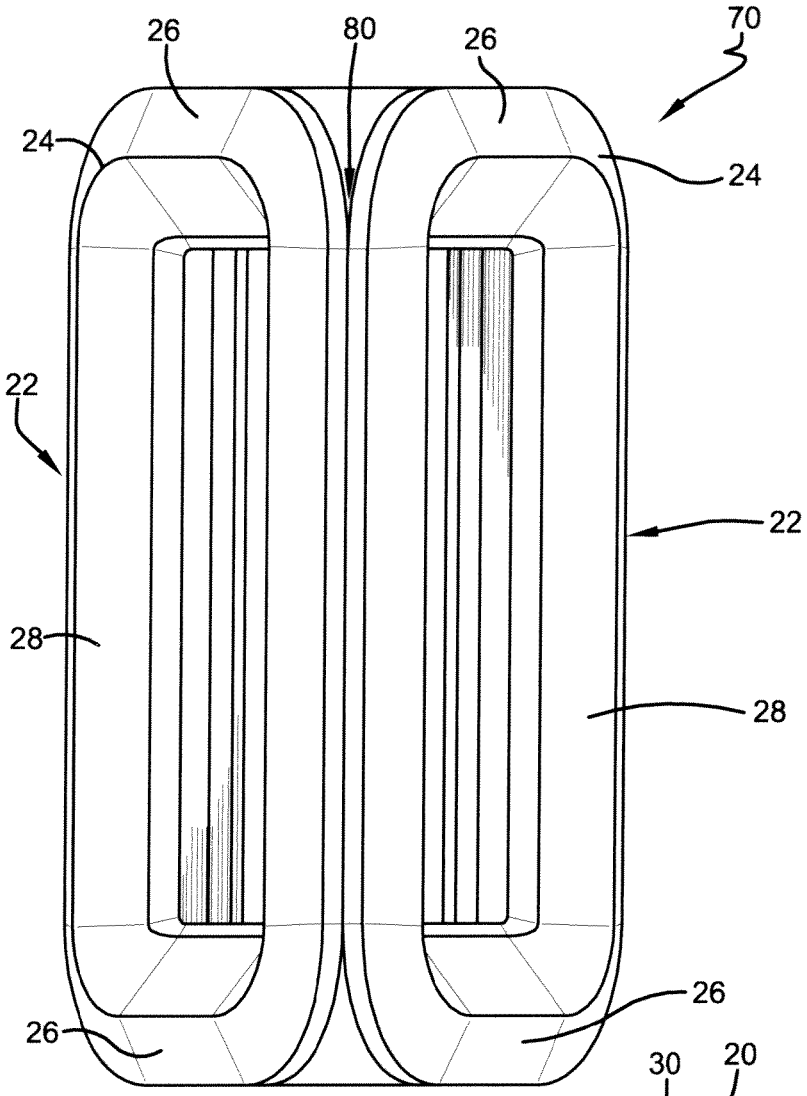
FIG. 1A is a perspective view of a non-linear core embodied in accordance with the present invention.

A non-linear transformer 100 core 70 is shown in FIG. 1A. The core 70 for the non-linear transformer 100 is formed of a material such as amorphous metal or grain-oriented silicon steel. In an embodiment utilizing amorphous metal, the transformer 100 exhibits lower hysteresis and eddy current energy losses. However, due to the thin and brittle nature of amorphous metal, a transformer core 70 utilizing amorphous metal is difficult to produce. For example, the thickness of amorphous metal used in forming the core 70 is about 0.025 mm thick whereas conventional grain-oriented silicon steel utilized in forming the core 70 is about 0.27 mm thick.

The core 70 is formed from at least three core frames 22. Each of the at least three core frames 22 has two leg portions 28 and two yoke portions 26 connected together by shoulders 24 to form a substantially rectangular shape having rounded edges. Each leg portion 28 of the at least three core frames 22 abuts a leg portion 28 of another core frame 22 to form a core leg 80 as shown in FIG. 1D. Each of the at least three core legs 80, formed by two semi-circular leg portions 28, has a substantially circular cross section, as best shown in FIG. 2 and the inset of FIG. 2A. The leg portions 28 of the at least three core legs 80 are secured together using a dielectric tape, band, or wrap. An assembled core 70 has a triangular shape when viewed from above as depicted in FIG. 1B.

Figure 1B:
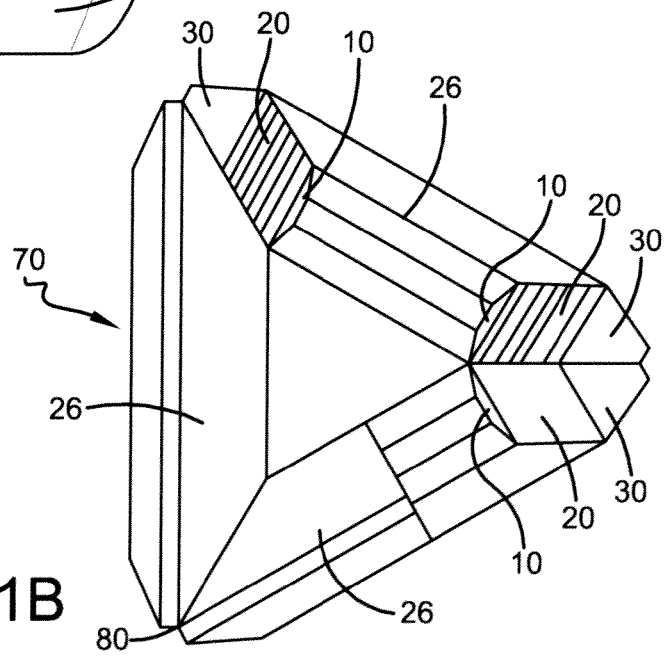
FIG. 1B is a top plan view of a non-linear core showing the first, second, and third sections of laminations used to form the non-linear core.
Figures 2, 2A:
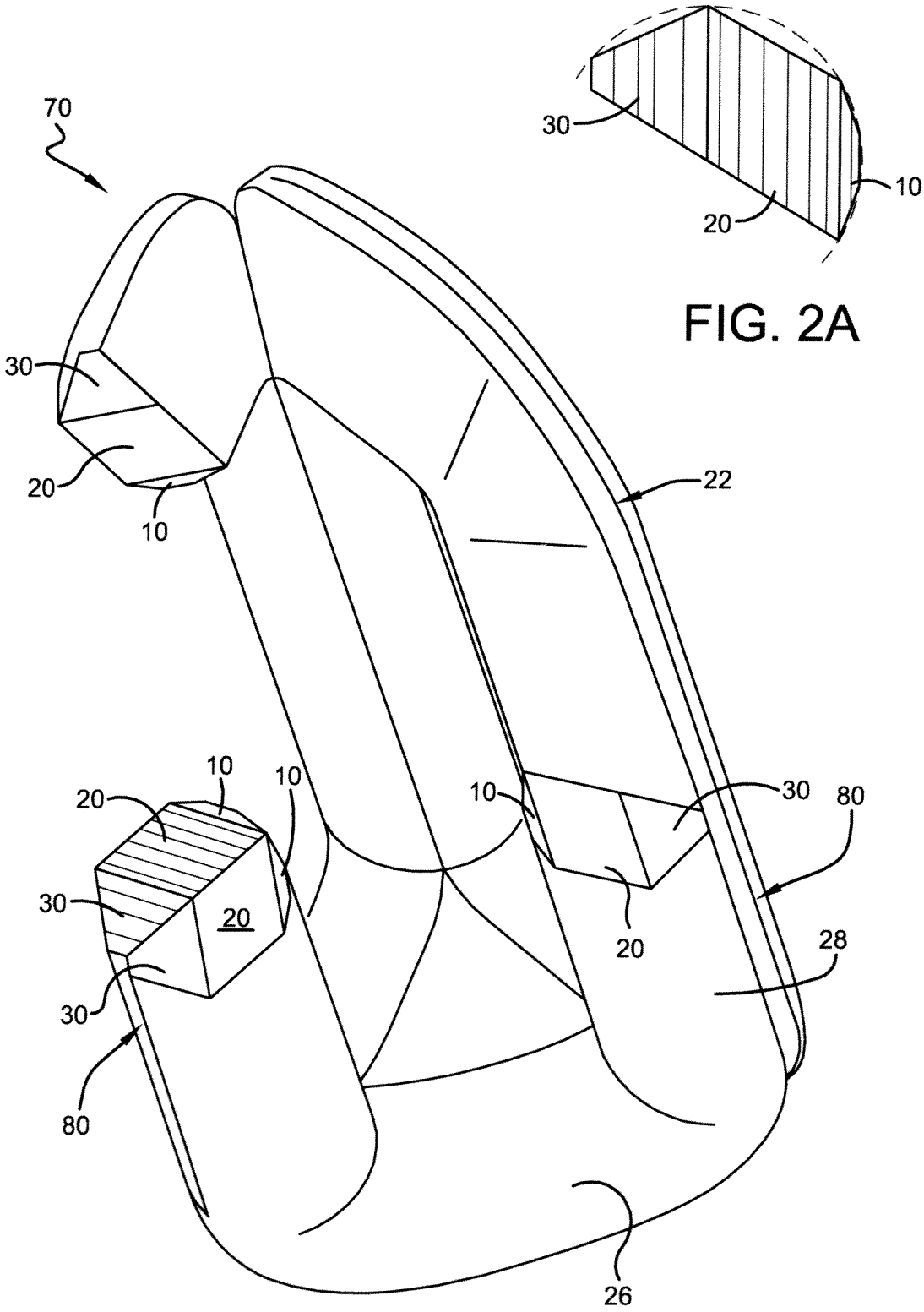
FIG. 2 is a perspective view of a non-linear core having first, second, and third sections of laminations forming each core frame, respectively.
FIG. 2A is an inset showing the layers that make up the first, second, and third sections of laminations in relation to a semi-circle to depict the fill factor achieved using circular coil windings.

Continuing with reference to FIG. 1B, each core frame 22 of the core 70 is formed of three steps, ie. first, second, and third sections of laminations 10, 20, 30 comprising the first, second, and third steps, respectively. The first, second, and third sections of laminations 10, 20, 30 are embodied as strips, sheets, foils or wires of grain-oriented silicon steel or amorphous metal.

The first, second and third sections of laminations 10, 20, 30 are comprised of continuous strips or sheets of metal. A core 70 comprised of grain-oriented silicon steel may be formed from continuous strips, sheets, foils or wires whereas a similar core 70 using amorphous metal is formed from continuous strips or sheets of metal. It should be understood that the number of layers of laminations in a core utilizing amorphous material or conventional grain-oriented silicon steel may vary widely depending upon the material used, the application, and the desired transformer output rating.

Figure 1C:
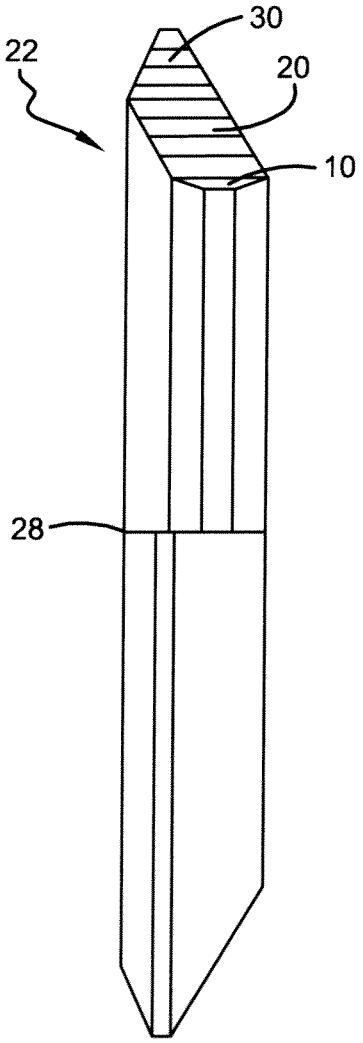
FIG. 1C is a side view of a core frame of the non-linear core.
Figure 1D:
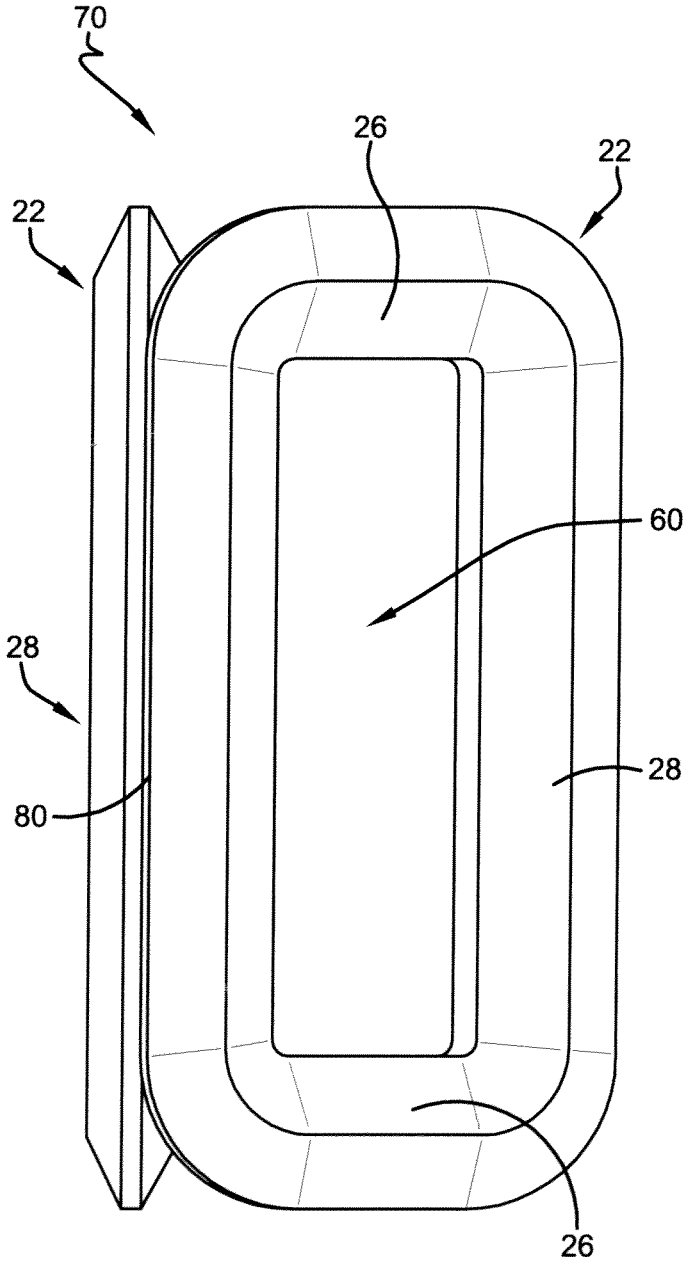
FIG. 1D shows FIG. 1A rotated slightly to depict the side of a core frame and a front face of another core frame.

Each of the first, second and third sections of laminations 10, 20, 30 have several wound layers that after winding have different cross-sectional areas, respectively. The first section of laminations 10 forms the interior portion of each core frame 22 and has a trapezoidal shape as depicted in FIGS. 1B and 1C. The second section of laminations 20 forms the center portion of each core frame 22 and has a generally rhomboid or diamond-shaped cross section as is depicted in FIG. 2. The third section of laminations 30 forms the outer portion of each core frame 22 and has a trapezoidal cross section and has a larger cross-sectional area than the first section of laminations 10. Overall, the second section of laminations 20 has the largest cross-sectional area.

In an embodiment using sheet metal or metal strips to form the core 70 the first and third sections of laminations 10, 30 are formed using a standard cross-slitting machine that is well known in the art. The second section of laminations 20 utilizes a sheet of metal that does not require cross-slitting and may be of a standard size, such as 150 mm wide. The first and third sections of laminations 10, 30 may also be formed from a metal sheet or strip that is 150 mm wide before it is cross-slit.

The first section of laminations 10 is formed from a generally rectangular sheet or strip of metal. The rectangular sheet is cross-slit using a diagonal cut across the length of the metal sheet or strip, forming two equal parts each having a generally triangular shape. Alternatively, a corner portion may be severed from the rectangular metal sheet or strip and discarded as scrap, leaving a single part. The winding of the first section of laminations 10 begins with the narrowest portion of the metal sheet whether the metal sheet or strip has a generally triangular shape or has a generally rectangular shape with a missing corner portion. The narrowest portion of the metal sheet is the portion that forms the smallest angle in relation to the right angle of a generally triangular shape or the portion having the severed corner in a generally rectangular metal sheet.

The third section of laminations 30 is formed from a rectangular sheet of metal that is longer than the rectangular sheet used to form the first section of laminations 10. In one embodiment, the rectangular metal sheet is cut diagonally across the length of the sheet to form two parts of equal size. Each of the two sections is used in a different core frame 22. The winding of the third section of laminations 30 begins with the widest portion of the metal sheet. For example, the widest portion of the metal sheet is the opposite of side of the rectangular metal sheet from that which is chosen to begin the winding of the first section of laminations 10.

Alternatively, a first part cut from the rectangular sheet of laminations is used the first section of laminations 10 and the second part is used in the third section of laminations 30. The cross-slit material is not used in the second section of laminations because the second section of laminations has a uniform width. Therefore, the cross-slitting machine is not utilized in the formation of the sheet or strip of metal used to produce the second section of laminations 20.

Figure 3:
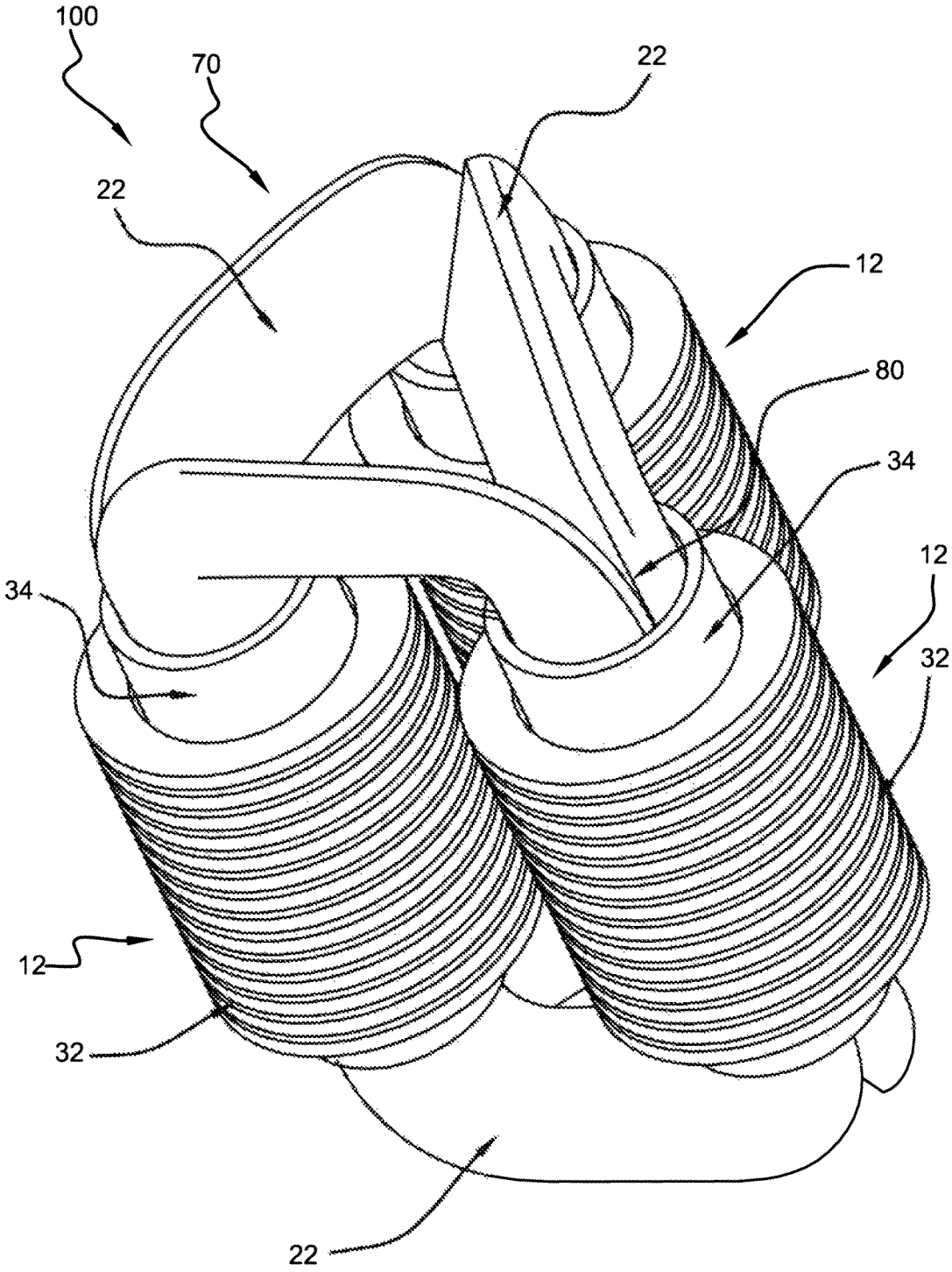
FIG. 3 is a perspective view of a non-linear transformer having primary and secondary coil windings.

The cross-sectional shape of the layers of laminations of the first, second, and third sections of laminations 10, 20, 30 that form a core frame 22 approximates the shape of a semicircle as depicted in FIG. 2A. When two leg portions 28 are positioned and/or joined together to form a core leg 80, the core leg 80 has a substantially circular cross-sectional area. The substantially circular cross-section of the core legs 80 provides an increased fill factor when used with circular primary and secondary coil windings 32, 34 as depicted in FIG. 3. The fill factor of a transformer core 70 using first, second, and third sections of laminations 10, 20, 30 having different cross-sectional areas and angles of offset as described below may fill about 89 percent of the area inside a generally annular coil assembly 12 made up of primary and secondary coil windings 32, 34.

In FIG. 3, the coil assemblies 12 are mounted to each of the at least three core legs, respectively. The coil assemblies 12 are formed of a secondary coil winding 34 mounted to each of the at least three core legs, respectively and a primary winding 32 disposed around the secondary winding 34. When the primary winding 32 is a high voltage winding and the secondary winding 34 is a low voltage winding, the transformer 100 is a so-called "step-down" transformer 100 which steps down the voltage and current values at the output of the transformer 100. Alternatively, the transformer 100 may be embodied as a "step-up" transformer 100 wherein the primary winding is a low voltage winding and the secondary winding 34 is a high voltage winding. It should be understood that in certain configurations the primary winding 32 may be wound around or otherwise mounted to each of the at least three core legs, respectively, and the secondary coil 34 winding may further be disposed around the primary coil winding 32.

In forming the transformer core 70, the first section 10 of laminations is wound directly on a generally rectangular mold having rounded edges. The first layer of the first section of laminations 10 of strip, sheet, foil or wire covers the outside end surfaces of the rectangular mold. The mold occupies the space of the core window 60 of the core frame 22, essentially creating the core window 60 during the core winding process. Successive layers of laminations form the various cross-sectional areas of the first, second and third sections of laminations 10, 20, 30, respectively. The first section of laminations 10 is wound upon the mold, the second section of laminations 20 is wound upon the first section of laminations 10, and the third section of laminations 30 is wound upon the second section of laminations 20. In certain embodiments, one or more layers of the second section of laminations may come in contact with the mold.

The first section of laminations 10 is wound successively so that all adjacent laminations and/or at least the first layer of the first, second, and third sections of laminations 10, 20, 30 are offset by a predetermined angle from all surrounding laminations and/or the first layers 15, 25, 35 of the surrounding sections 10, 20, 30. The result is a trapezoidal cross section of the first section of laminations 10 as shown in the inset of FIG. 2*a*.

Each of the first, second and third sections of laminations 10, 20, 30 begin as a pre-cut roll of lamination sheeting or strip that is placed onto a de-coiling device which may be manual or automatic in operation. The first section of laminations 10 is fed into a lamination shifting machine with the narrowest end portion of the sheet or strip fed first. The second section of laminations is a constant width so may be fed beginning with either end of the sheet or strip. The third section of laminations 30 is fed into the laminations shifting machine starting with the widest end portion of the sheet or strip. The lamination shifting machine which is used to control the offset angle of adjacent laminations.

The lamination shifting machine is a form of linear automation that is known in the art of forming transformer cores 70. The lamination shifting machine has a table upon which are mounted a set of rollers and a clamping assembly. The lamination sheet or strip is first fed into the set of rollers and then the clamping assembly grasps and shifts the laminations to predetermined positions along a horizontal axis of the table of the lamination shifting machine.

The lamination strip or sheet, after being positioned at the proper angle of offset for each layer using the lamination shifting machine, is then fed into a core winding machine having a generally rectangular mold with rounded edges. For every full rotation of the coil winding machine a layer of the first, second or third groups of laminations 10, 20, 30 is created with each layer being offset at a predetermined angle from adjacent layers using the lamination shifting machine. For example, a full rotation of the coil winding machine is the rotation of the mold from a single point, for example a point on the corner of the mold until the mold rotates forward or backward to that same single point on the corner of the mold.

The lamination strips or sheets are wound successively, one layer upon another as the mold of the coil winding machine rotates end over end, with each layer of the lamination strip or sheet at a different offset angle from the previous layer. The result is a first section of laminations 10 having a trapezoidal cross section, the second section of laminations 20 having a rhombic cross section, and the third section of laminations 30 having a trapezoidal cross section as depicted in FIG. 1*c*.

Figure 4:
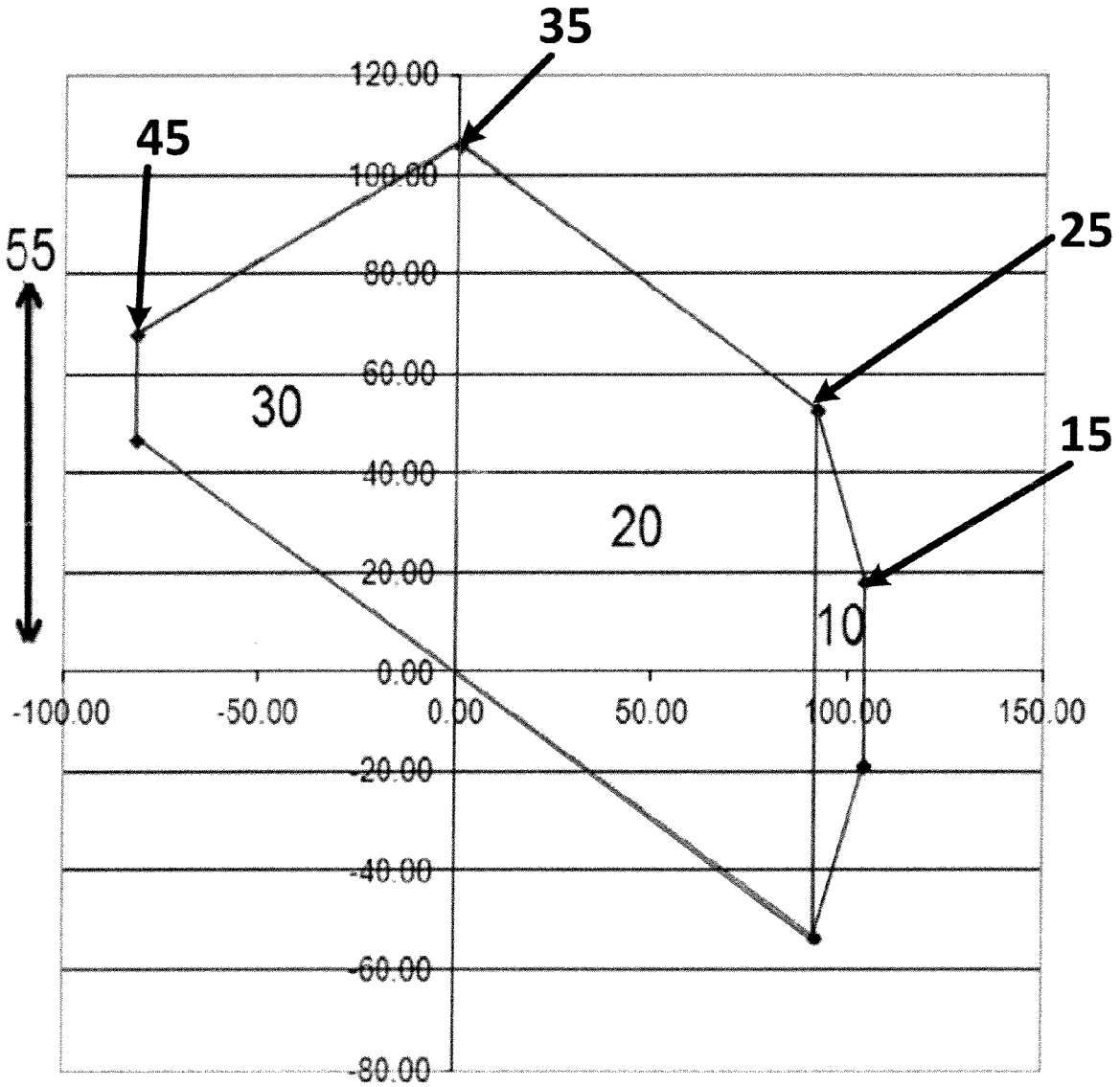
FIG. 4 shows an exemplary cross section of a core frame superimposed on a Cartesian grid to illustrate the exemplary angles of offset between the first, second and third sections of laminations, particularly the exemplary angles of offset between at least a first layer of each of the first, second and third sections of laminations.

With reference to FIG. 4, a cross-sectional view of a core frame 22 arranged on a Cartesian grid is shown. The direction 55 of the width of the first, second, and third sections of laminations 10, 20, 30 is denoted by an arrow having two ends, and corresponds to the y-axis of the grid. The core frame 22 is shown superimposed on the Cartesian grid to depict the manner in which the cross-section of the core frame 22 fills a semi-circle wherein the boundaries of the semi-circle are denoted by points representing the first layers of the first, second and third sections of laminations 15, 25, and a point representing the last layer of the third section of laminations 45.

In one embodiment, the offset angle of the first layer of laminations in each of the first, second, and third sections of laminations 15, 25, 35 is about 10 degrees, about 30 degrees, and about 90 degrees, respectively, from the horizontal axis or x axis of the grid as depicted in FIG. 4. It follows that the first layer of the first group of laminations 15 is about ten degrees from the horizontal axis, the first layer of the second group of laminations 25 is about 20 degrees from the first layer of the first group of laminations 15, the first layer of the third group of laminations 35 is about 60 degrees from the first layer of the second group of laminations 25, and the last layer of the third group of laminations 45 is about 140 degrees from the horizontal axis. The last layer is of the third group of laminations 45 is also about 130 degrees from a first layer of the first group of laminations 15.

It should be understood that the above are provided as exemplary angles of offset as between each of at least the first layers of the first, second, and third sections of laminations, respectively. Other angles of offset are possible depending upon the application and the material utilized. Accordingly, each layer of each of the first, second, and third sections of laminations may be offset from each successive or adjacent layer by one or more pre-determined angles of offset with the goal of substantially filling a semi-circular or circular cross-sectional shape.

While the present application illustrates various embodiments, and while these embodiments have been described in some detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative embodiments, and illustrative examples shown and described. Accordingly, departures may be made from such details without departing from the spirit or scope of the applicant's general inventive concept.

What is claimed is:

1. A three-phase non-linear transformer, comprising:

a ferromagnetic core comprising:

at least three core frames each having first, second, and third sections of successive lamination layers, and wherein each of said first and third sections of lamination layers are wound successively upon one another and positioned at an angle of offset from adjacent layers to form a generally trapezoid-shaped cross section, said second section of lamination layers disposed between said first and third sections of lamination layers and wherein each layer of said second section of laminations is arranged at an angle of offset from adjacent lamination layers to form a generally rhomboid-shaped cross section, said at least three core frames arranged in a non-linear configuration, each of said at least three core frames comprising a leg section and a yoke section, each of said leg sections combining with a leg section of another core frame to form at least three core legs having substantially circular cross-sections, respectively; and coil assemblies mounted to each of the at least three core legs, said coil assemblies comprising:

a secondary winding wound around each of the at least three core legs, respectively; and a primary winding disposed around the secondary winding.

2. The non-linear transformer of claim 1 wherein the at least three core legs are arranged in a triangular configuration.

3. The non-linear transformer of claim 1 wherein said third section of laminations has a larger cross-section than said first section of laminations.

4. The non-linear transformer of claim 1 wherein said first, second, and third sections of laminations are formed from amorphous metal.

5. The non-linear transformer of claim 1 wherein said first, second, and third sections of laminations are formed from grain-oriented silicon steel.

6. The non-linear transformer of claim 1 wherein the first layer of said first section of laminations is offset by about 10 degrees in relation to a position of each said at least three core legs with respect to a horizontal axis.

7. The non-linear transformer of claim 1 wherein the first layer of said second section of laminations is offset by about 20 degrees in relation to a first layer of a first section of laminations further in relation to a position of each said at least three core legs with respect to a horizontal axis.

8. The non-linear transformer of claim 6 wherein a first layer of said second section of laminations is offset from a first layer of the third section of laminations by about 60 degrees in relation to a position of each of said at least three core legs with respect to a horizontal axis.

9. The non-linear transformer of claim 7 wherein a last layer of said third section of laminations is offset from a first layer of a first section of laminations by about 130 degrees in relation to a position of each of said at least three core legs with respect to a horizontal axis.

10. A three-phase transformer comprising:

a ferromagnetic core comprising:

at least three core frames having a leg section and a yoke section, each of said leg sections combining with a leg section of another core frame to form at least three core legs, respectively, said at least three core frames arranged in a non-linear configuration and having first, second, and third sections of successively wound lamination layers positioned at an angle of offset with respect to adjacent lamination layers, respectively, said first and third sections of lamination layers being formed from a single sheet of cross-slit material divided into first and second triangular sections, said first section of lamination layers being wound beginning with the narrowest portion of the first triangular section and said third section being wound beginning with the widest portion of the second triangular section so that said first and third sections form generally trapezoid-shaped cross sections, respectively, and said second section of lamination layers formed of a sheet of constant width and disposed between said first and third sections of lamination layers, said second section of lamination layers arranged at an angle of offset from adjacent lamination layers to form a generally rhomboid-shaped cross section; and coil assemblies mounted to each of the at least three core legs, said coil assemblies comprising:

a secondary winding wound around each of the at least three core legs, respectively; and a primary winding disposed around the secondary winding.

11. The transformer of claim 10 wherein said third section of laminations has a larger cross-section than said first section of laminations.

12. The transformer of claim 10 wherein said first, second, and third sections of laminations are formed from amorphous metal.

13. The transformer of claim 10 wherein said first, second, and third sections of laminations are formed from grain-oriented silicon steel.

14. The transformer of claim 10 wherein said first section of lamination layers forms the interior portion of each core frame and said third section of lamination layers forms the outer portion of each core frame.

* * * * *